US008876489B2

(12) United States Patent
Shener

(10) Patent No.: US 8,876,489 B2
(45) Date of Patent: Nov. 4, 2014

(54) PERISTALTIC PUMPING APPARATUS AND METHOD

(76) Inventor: Cemal Shener, Woburn, MA (US)

( * ) Notice: Subject to any disclaimer, the term of this patent is extended or adjusted under 35 U.S.C. 154(b) by 49 days.

(21) Appl. No.: 13/450,512

(22) Filed: Apr. 19, 2012

(65) Prior Publication Data

US 2013/0101441 A1 Apr. 25, 2013

Related U.S. Application Data

(60) Continuation of application No. 13/312,921, filed on Dec. 6, 2011, now Pat. No. 8,167,592, which is a division of application No. 12/394,467, filed on Feb. 27, 2009, now Pat. No. 8,087,909.

(60) Provisional application No. 61/031,799, filed on Feb. 27, 2008.

(51) Int. Cl.
*F04B 43/12* (2006.01)
*F04B 11/00* (2006.01)

(52) U.S. Cl.
CPC ..... *F04B 11/00* (2013.01); *F04B 43/1292* (2013.01)
USPC ..... 417/53; 417/477.3

(58) Field of Classification Search
None
See application file for complete search history.

(56) References Cited

U.S. PATENT DOCUMENTS 3,723,030 A 3/1973 Gelfand
3,737,251 A 6/1973 Berman et al.
3,787,148 A 1/1974 Kopf et al.
4,155,362 A * 5/1979 Jess ..... 417/477.11
4,537,561 A 8/1985 Xanthopoulos
4,549,860 A 10/1985 Yakich
4,564,342 A 1/1986 Weber et al.
4,902,277 A 2/1990 Mathies et al.
4,952,372 A 8/1990 Huber
5,000,733 A 3/1991 Mathies et al.
5,131,823 A 7/1992 Guignard
5,257,917 A * 11/1993 Minarik et al. ..... 417/475
5,571,389 A * 11/1996 Kerampran ..... 204/224 R (Continued)

FOREIGN PATENT DOCUMENTS

GB 1 498 376 1/1978
GB 2 102 503 2/1983

(Continued)

OTHER PUBLICATIONS

International Search Report and Written Opinion for PCT/US2009/035416 Dated Jun. 24, 2009.

(Continued)

*Primary Examiner* — Britt D Hanley

(57) ABSTRACT

The present disclosure relates to a rotor assembly for a peristaltic pump. The pump includes a first rotor having a plurality of rollers and a second rotor, coupled to the first rotor, having a plurality of rollers. The rollers of the first and second rotors are located at an angle of about 45° relative to each other. In an embodiment, the first rotor and the second rotor are circular. In another embodiment, the rollers of the first rotor are equally spaced or located at an angle, about 90°, relative to each other. In yet another embodiment, the rollers of the second rotor are equally spaced or located at an angle, about 90°, relative to each other. A peristaltic pump and a method of supplying fluid to a surgical area are also disclosed.

20 Claims, 2 Drawing Sheets

(56) References Cited

U.S. PATENT DOCUMENTS

| | | | |
|---|---|---|---|
| 5,927,956 | A | 7/1999 | Lim et al. |
| 6,527,745 | B1 | 3/2003 | Kanda et al. |
| 2005/0238515 | A1 | 10/2005 | Kent |

FOREIGN PATENT DOCUMENTS

| | | |
|---|---|---|
| JP | 60-26295 | 2/1985 |
| JP | H06-280749 | 10/1994 |
| JP | H07-278625 | 10/1995 |
| JP | H11-193785 | 7/1999 |
| WO | 82/04291 | 12/1982 |
| WO | WO00/70225 | 11/2000 |
| WO | WO2006/013316 | 2/2006 |

OTHER PUBLICATIONS

Office Action for corresponding Japanese Patent Application No. 2010-548892 mailed Jun. 18, 2013.

Office Action for corresponding Japanese Patent Application No. 2010-548892 mailed Oct. 29, 2013.

Office action received in corresponding Japanese patent application No. 2010-548892 mailed Apr. 28, 2014.

Office Action received in corresponding Australian application No. 2009219172 mailed Feb. 28, 2013.

* cited by examiner

PERISTALTIC PUMPING APPARATUS AND METHOD

CROSS-REFERENCE TO RELATED APPLICATIONS

This application claims the benefit of U.S. patent application Ser. No. 13/312,921, filed Dec. 6, 2011, which claims the benefit of U.S. patent application Ser. No. 12/394,467, filed Feb. 27, 2009, which claims the benefit of U.S. Patent Application Ser. No. 61/031,799, filed Feb. 27, 2008, the disclosures of which are incorporated by reference herein in their entireties.

BACKGROUND

1. Field of Technology

The present disclosure relates generally to peristaltic pumps and, more specifically, to a rotor assembly for a peristaltic pump.

2. Related Art

Current peristaltic pumping systems that are used in endoscopic surgeries, such as arthroscopy and hysteroscopy, create fluctuations in pressure and flow. These fluctuations are the result of rollers that rotate around an axis while applying force on a flexible tube that is typically wrapped around the rollers. In essence, this rotational motion of the rollers creates fluid pockets, within the tube, that continually get pushed through the tube, thereby creating flow. Due to the nature of these fluid pockets, the resultant flow and pressure of the rollers have a tendency to fluctuate. In surgery, this problem manifests itself as an unstable surgical environment that includes, without limitation, having a poor view for the surgical staff, movement of tissue or organ within the surgical cavity, varying cavity volume, and slow pump response to varying flow demands.

One method of addressing the above-stated problem has been to use an in-line chamber. The chamber is part of the tube, is located downstream of the rollers, and, in addition to containing liquid, is also partially filled with air so that it can act as a cushion to soften the fluctuations. The user is responsible for filling the chamber with the correct amount of liquid in order to ensure that a sufficient amount of air is left in the chamber. Often, users do not do this properly, which in turn substantially reduces the effect of the chamber. In addition to user error, this chamber is an added cost in the price of the tubing.

A peristaltic apparatus and method of application, that substantially reduces pressure and flow output fluctuations, is needed.

SUMMARY

In one aspect, the present disclosure relates to a rotor assembly for a peristaltic pump. The rotor assembly includes a first rotor having a plurality of rollers and a second rotor, coupled to the first rotor, having a plurality of rollers. The rollers of the first and second rotors are located at an angle of about 45° relative to each other. In an embodiment, the first rotor and the second rotor are circular. In another embodiment, the rollers of the first rotor are located at an angle, about 90°, relative to each other. In yet another embodiment, the rollers of the second rotor are located at an angle, about 90°, relative to each other. In a further embodiment, the second rotor has a smaller diameter than the first rotor.

In another aspect, the present disclosure relates to a pump. The pump includes a first tubing and a second tubing, wherein the second tubing has a first end coupled to the first tubing and a second end coupled to the first tubing; an arcuate support surface arranged to support the first tubing, the first tubing being arranged to extend around the arcuate support surface; and a rotor assembly arranged to rotate about an axis, the first rotor including a plurality of rollers and a second rotor including a plurality of rollers, the second rotor coupled to the first rotor, the rollers of the first and second rotors located at an angle relative to each other. The rollers of the first rotor squeeze the first tubing against the support surface as the rotor assembly rotates and the rollers of the second rotor compress the second tubing as the rotor assembly rotates. In an embodiment, the first tubing has a larger diameter than the second tubing.

In yet another aspect, the present disclosure relates to a method of supplying fluid to a surgical area. The method includes providing a pump including a first tubing and a second tubing, the second tubing having a first end coupled to the first tubing and a second end coupled to the first tubing, an arcuate support surface arranged to support the first tubing, the first tubing being arranged to extend around the arcuate support surface, and a rotor assembly arranged to rotate about an axis, the rotor assembly including a first rotor having a plurality of rollers and a second rotor having a plurality of rollers, the second rotor coupled to the first rotor, the rollers of the first and second rotors located at an angle relative to each other; providing a fluid from a fluid source into the first and second tubings; operating the pump such that rotation of the rotor assembly causes the rollers of the first rotor to squeeze the first tubing against the support surface and create fluid pockets within the first tubing and causes the rollers of the second rotor to compress the second tubing and create fluid pockets within the second tubing. The fluid pockets of the first and second tubing are delivered to the surgical area by the first tubing.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The accompanying drawings, which are incorporated in and form a part of the specification, illustrate the embodiments of the present disclosure and together with the written description serve to explain the principles, characteristics, and features of the disclosure. In the drawings.

DETAILED DESCRIPTION OF THE EMBODIMENTS

The following description of the preferred embodiment(s) is merely exemplary in nature and is in no way intended to limit the disclosure, its application, or uses.

Figure 1:
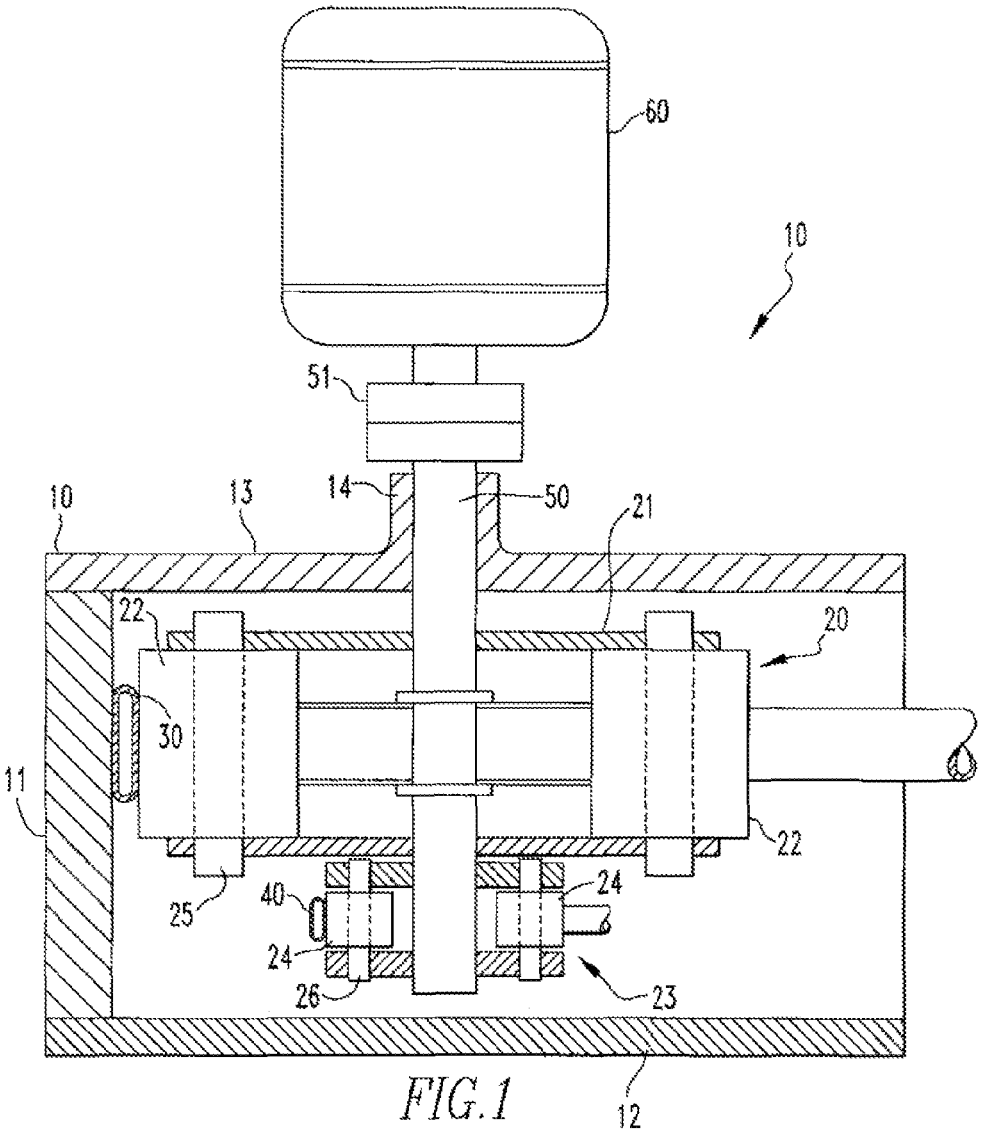
FIG. 1 shows a top view of the peristaltic pump of the present disclosure.
Figure 2:
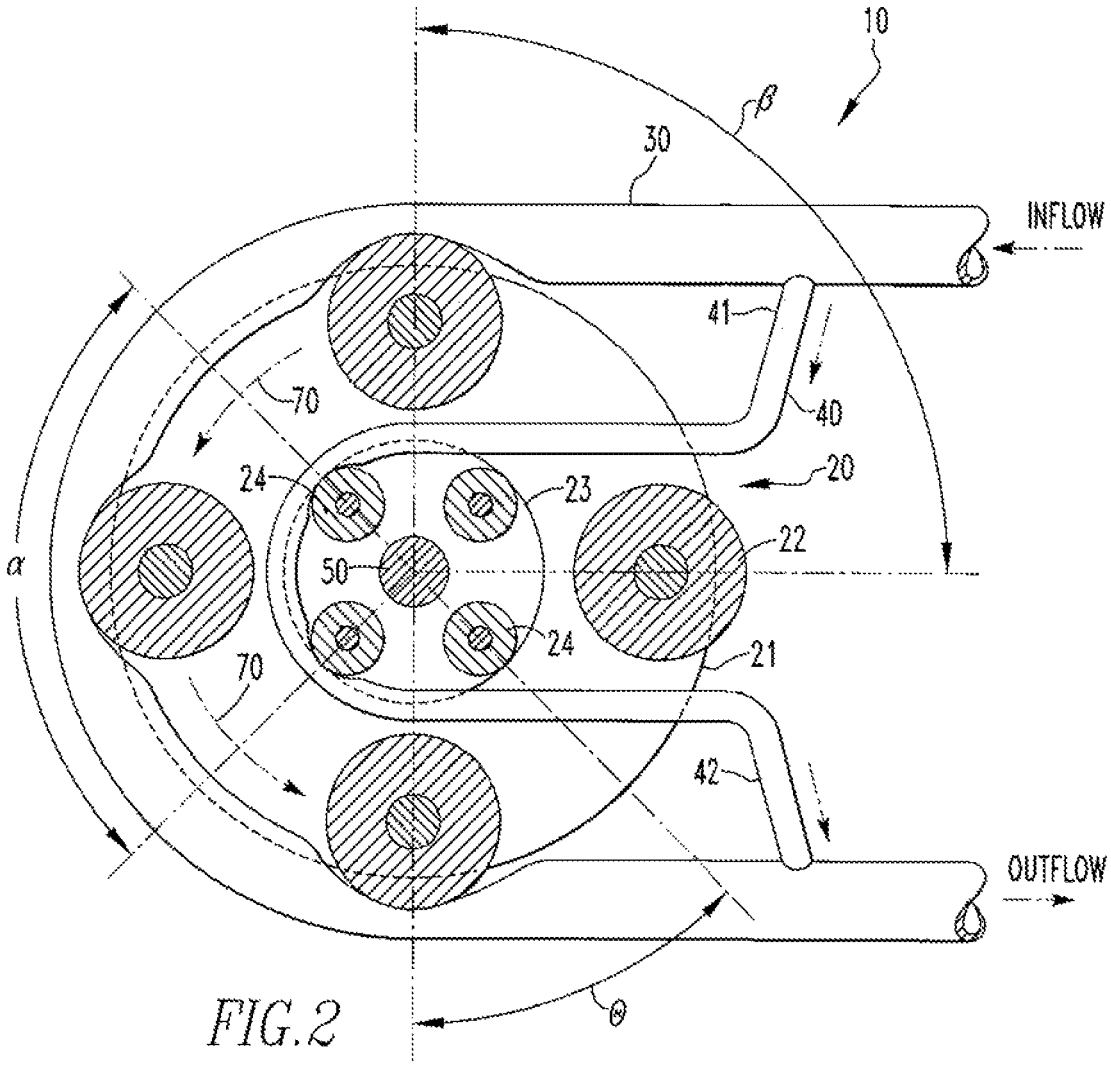
FIG. 2 shows a front view of the peristaltic pump of the present disclosure.

FIGS. 1 and 2 show the peristaltic pump 10 of the present disclosure. The pump 10 includes a housing 10, a rotor assembly 20, and flexible tubes 30, 40. For the purposes of this disclosure; the housing 10 and rotor assembly 20 may include metal, plastic, or another material suitable for a housing and rotor assembly of a peristaltic pump. The flexible tubes 30, 40 include silicone, polyvinyl chloride (PVC), or any other material suitable for tubes used in a peristaltic pump for carrying fluid. Inside the housing 10 is constructed an arcuate support surface 11 for supporting tube 30. At the front, the housing 10 is closed with a front cover 12 and at the back with a back cover 13 provided with a bearing 14. The rotor assembly 20 is located on a shaft 50 that extends through the back cover 13 via the bearing 14. The assembly 20 includes a first rotor 21 having rollers 22. For the purposes of this disclosure, the first rotor 21 includes four rollers 22, however, the rotor 21 may include a higher or lesser number of rollers 22. Also for the purposes of this disclosure, the rollers 22 are equally spaced or located at an angle β of about 90° relative to each other, and are coupled to the rotor 21 by metal pins 25. However, the pins 25 may be of a material other than metal, the rollers 22 may be coupled to the rotor 21 in another manner rather than by pins 25, and the rollers 22 may be non-equally spaced. The assembly 20 also includes a second rotor 23 coupled to the first rotor 21. The second rotor 23 includes rollers 24 that are also equally spaced, or located at an angle α of about 90° relative to each other. As with the first rotor 21, the second rotor 23 includes four rollers, but may include a higher or lesser number of rollers and the rollers may be non-equally spaced. The rollers 24 are coupled to the rotor 23 by metal pin 26, but the pin 26 may be of a material other than metal and the rollers 24 may be coupled to the rotor 23 in another manner rather than by pins 26.

For the purposes of this disclosure, the rollers 24 of the second rotor 23 are located at an angle Θ of about 45° relative to the rollers of the first rotor 21. However, angle Θ may be more or less than 45°. The first rotor 21 has a larger diameter than the second rotor 23, with the first rotor 21 being between about 5 cm to about 10 cm and the second rotor 23 being between about 2 cm and about 4 cm. The part of the rotor shaft 50 that is extending out of the housing 10 is by means of a coupling 51 coupled to a motor 60 for rotating the rotor assembly 20 during operation.

First tube 30 is located between arcuate support surface 11 and the first rotor 21. Second tube 40 has a first end 41 and a second end 42, wherein each end 41, 42 is coupled to the first tube 30. The second tube 40 extends around the second rotor 23.

During operation, fluid flows from a fluid source (not shown) into the first tube 30 with some of the fluid entering the second tube 40 as the fluid approaches the rollers 22 of the first rotor 21. For the purposes of this disclosure, the fluid is saline, but may be another type of biocompatible fluid. The rotor assembly 20 rotates in a counter-clockwise manner, as indicated by arrow 70. The rollers 22, 24 of the first and second rotors 21, 23 apply pressure to the first and second tubes 30, 40, which creates fluid pockets, within the tubes 30, 40, that continually get pushed through the tubes 30, 40, thereby creating flow. The fluid pockets of the second tube 40 are deposited into the first tube 30 at the second end 42. The fluid pockets of the first and second tubes 30, 40 are then delivered to the surgical area.

Since the first and second rotors 21, 23 are located on the same shaft, the velocity, or revolutions per minute (RPM) of the rotors 21, 23 are the same. However, due to the rollers 24 of the second rotor 23 being located at an angle relative to the rollers 22 of the first rotor 21, there is a delay between when the first rotor 21 starts to push a pocket of fluid through the first tube 30 and when the second rotor 23 starts to push a pocket of fluid through the second tube 40. Additionally, as mentioned above, the second tube 40 has a smaller diameter than the first tube 30 and thus is capable of pushing smaller fluid pockets than the first tube 30. Consequently, the fluid flow rate of the first and second tubes 30, 40 are different with the fluid flow rate of the first tube 30 having periods of high and low flow that are opposite the periods of high and low flow of the second tube 40, i.e. when the first tube 30 has a period of high flow, the second tube 40 will have a period of low flow and vice-versa. Therefore, it is believed that a flow and pressure output will result that has smaller fluctuations in pressure and flow as compared to rotor assemblies having one rotor delivering the fluid, via a tube, to a surgical site.

As various modifications could be made to the exemplary embodiments, as described above with reference to the corresponding illustrations, without departing from the scope of the disclosure, it is intended that all matter contained in the foregoing description and shown in the accompanying 'drawings shall' be interpreted as illustrative rather than limiting. Thus, the breadth and scope of the present disclosure should not be limited by any of the above-described exemplary embodiments, but should be defined only in accordance with the following claims appended hereto and their equivalents.

What is claimed is:

1. A method of supplying fluid to a surgical area comprising:

providing a pump comprising a first tubing and a second tubing, the second tubing having a first end coupled to the first tubing and a second end coupled to the first tubing; an arcuate support surface arranged to support the first tubing, the first tubing being arranged to extend around the first arcuate support surface; and a rotor assembly arranged to rotate about an axis, the rotor assembly comprising a first rotor including a plurality of rollers and a second rotor including a plurality of rollers, the second rotor coupled to the first rotor, the rollers of the first and second rotors located at an angle relative to each other;

providing a fluid from a fluid source into the first tubings; and operating the pump such that fluid from the first tubing is deposited into the second tubing and redeposited by the second tubing into the first tubing prior to delivery of the fluid to the surgical area by the first tubing.

2. The method of claim 1 wherein the first rotor and the second rotor are circular.

3. The method of claim 1 wherein the rollers of the first rotor are located at an angle relative to each other.

4. The method of claim 3 wherein angle is about 90°.

5. The method of claim 1 wherein the rollers of the second rotor are located at an angle relative to each other.

6. The method of claim 5 wherein the angle is about 90°.

7. The method of claim 1 wherein the angle is about 45°.

8. The method of claim 1 wherein the second rotor has a smaller diameter than the first rotor.

9. A pump comprising:

a first tubing and a second tubing, the second tubing having a first end coupled to the first tubing and a second end coupled to the first tubing;

an arcuate support surface arranged to support the first tubing, the first tubing being arranged to extend around the arcuate support surface; and a rotor assembly arranged to rotate about an axis, the rotor assembly comprising a first rotor including a plurality of rollers and a second rotor including a plurality of rollers, the second rotor coupled to the first rotor, the rollers of the first and second rotors located at an angle relative to each other, wherein the rotor assembly is operated such that fluid from the first tubing is deposited into the second tubing and redeposited into the first tubing by the second tubing prior to delivery of the fluid to a surgical area by the first tubing.

10. The pump of claim 9 wherein the first tubing has a larger diameter than the second tubing.

11. A rotor assembly for a peristaltic pump comprising:

a first rotor including a plurality of rollers; and a second rotor coupled to the first rotor, the second rotor including a plurality of rollers, wherein the rollers of the first and second rotors are located at an angle relative to each other, wherein the rollers of the first rotor are used to compress a first tubing and the rollers of the second rotor are used to compress a second tubing, the rotor assembly operated such that fluid from the first tubing is deposited into the second tubing and redeposited into the first tubing by the second tubing prior to delivery of the fluid to a surgical area by the first tubing.

12. The rotor assembly of claim 11 wherein the first rotor and the second rotor are circular.

13. The rotor assembly of claim 11 wherein the rollers of the first rotor are located at an angle relative to each other.

14. The rotor assembly of claim 13 wherein the angle is about 90°.

15. The rotor assembly of claim 11 wherein the rollers of the second rotor are located at an angle relative to each other.

16. The rotor assembly of claim 15 wherein the angle is about 90°.

17. The rotor assembly of claim 11 wherein the angle is about 45°.

18. The rotor assembly of claim 11 wherein the second rotor has a smaller diameter than the first rotor.

19. The method of claim 1 wherein the fluid pockets of the first and second tubing are delivered to the surgical area solely by the first tubing.

20. The method of claim 1 wherein the first and second rotors pump fluid in the same direction.

* * * * *